United States Patent [19]

Dugas

[11] Patent Number: 4,481,854

[45] Date of Patent: Nov. 13, 1984

[54] CONTROL FOR MUSICAL INSTRUMENTS

[75] Inventor: Paul Dugas, Quebec, Canada

[73] Assignee: JAM Ind., Ltd., Canada

[21] Appl. No.: 451,009

[22] Filed: Dec. 20, 1982

[51] Int. Cl.[3] ..... G10H 1/02

[52] U.S. Cl. ..... 84/1.19; 84/1.16; 84/1.27

[58] Field of Search ..... 84/1.14, 1.15, 1.16, 84/1.19, 1.27

[56] References Cited

U.S. PATENT DOCUMENTS

| | | | |
|---|---|---|---|
| 3,454,702 | 7/1969 | Elbrecht et al. | 84/1.14 |
| 3,478,158 | 11/1969 | Trainor | 84/1.16 |
| 3,663,735 | 5/1972 | Evans | 84/1.16 |
| 3,915,048 | 10/1975 | Stich | 84/1.14 |
| 4,010,668 | 3/1977 | Plueddemann | 84/1.16 |
| 4,305,320 | 12/1981 | Peavey | 84/1.16 |
| 4,422,360 | 12/1983 | Carter | 84/1.19 |

*Primary Examiner*—Forester W. Isen

*Attorney, Agent, or Firm*—Fishman & Dionne

[57] ABSTRACT

The invention relates to an electrical stringed and fretted musical instrument which has at least two pick-ups and a bass boost filter means and a high boost filter means. The output of the instrument is a combination of the magnitude of the pick-ups and the magnitude of the filter means. In accordance with the invention, a single joystick control varies all of these magnitudes simultaneously so as to simultaneously vary the entire combination with a single control. In accordance with a further embodiment of the invention, a second joystick control will simultaneously control volume and panning between two speakers.

8 Claims, 5 Drawing Figures

CONTROL FOR MUSICAL INSTRUMENTS

BACKGROUND OF THE INVENTION (a) Field of the Invention

The invention relates to an electrical stringed and fretted musical instrument having at least two pick-up means, a bass boost filter means and a high boost filter means. More specifically, the invention relates to such an instrument which includes combining means for providing an infinite combination of different amplitude signals from the pick-up means and the filter means, and for simultaneously varying the different signals.

The combining means can also provide simultaneous volume and panning control for the instrument.

(b) Description of Prior Art

Electrical stringed and fretted instruments are known in the art. Generally, the instruments include transducers for picking up the string vibrations and converting them to electrical signals. The transducers are referred to as pick-up means, and, in a guitar, the pick-up means can comprise a bridge pick-up and a finger board pick-up.

Electrical instruments of this type are illustrated in U.S. Pat. Nos. 3,454,702, Elbrecht et al, issued July 8, 1969; 3,478,158, Trainor, issued Nov. 11, 1969; 3,915,048, Stich, issued Oct. 28, 1975; and 4,305,320, Peavey, issued Dec. 15, 1981. In all of these references, controls are provided. However, the controls will vary only one variable at a time.

The instruments may also include bass and high boost filter means to emphasize, respectively, the bass notes or the treble notes being played. Typically, controls for these filter means will vary either the bass filter or the treble filter but not both.

Volume controls are also included in electrical stringed and fretted instruments for controlling volume at the output. In addition, in order to provide a stereo effect, the output of the instrument may be provided to two separated speakers. The distribution of output between the speakers is referred to as panning. Once again, separate panning and volume controls may be provided. In such a case, each speaker will be separately volume controlled.

There are no control systems available to Applicant's knowledge which permit simultaneous volume and panning control.

SUMMARY OF INVENTION

It is therefore an object of the invention to provide a control means for an electrical stringed and fretted musical instrument which provides an infinite combination of different amplitude signals from pick-up means and filter means thereof while permitting simultaneous varying of the signals.

It is a further object of the invention to provide control means for such an instrument which provides simultaneous volume and panning controls.

In accordance with the broadest aspect of the invention, such combination and variation is provided with the use of a 2-axis joystick control means.

In accordance with a particular embodiment there is provided an electrical stringed and fretted musical instrument which includes a first pick-up means and a second pick-up means. Also provided are a first potentiometer having a first end, a second end and a slider arm disposed between said first and second ends, the first pick-up means being connected to the first end and the second pick-up means being connected to the second end of the first potentiometer. Further provided are a high pass filter means having an input terminal and an output terminal, and a low pass filter means having an input terminal and an output terminal. The slider arm of the first potentiometer is connected in parallel to both the low pass filter means input terminal and the high pass filter means input terminal. Further provided are a second potentiometer having a first end, a second end, and a slider arm disposed between the first and second ends. The output terminal of the high pass filter means is connected to the first end of the second potentiometer, and the output terminal of the low pass filter means is connected to the second end of the second potentiometer. The slider arm of the second potentiometer is connected to output means. Wherein, the first and second potentiometers are controlled by a 2-axis joystick means whereby to simultaneously combine the outputs of the first pick-up means and the second pick-up means, the high pass filter means and the low pass filter means at the output means.

In accordance with a further embodiment, the output means comprises two speaker amplifiers and means for simultaneously controlling the volume and panning of the two speaker amplifiers.

BRIEF DESCRIPTION OF DRAWINGS

The invention will be better understood by an examination of the following description together with the accompanying drawings in which.

DESCRIPTION OF PREFERRED EMBODIMENTS

Figure 1:
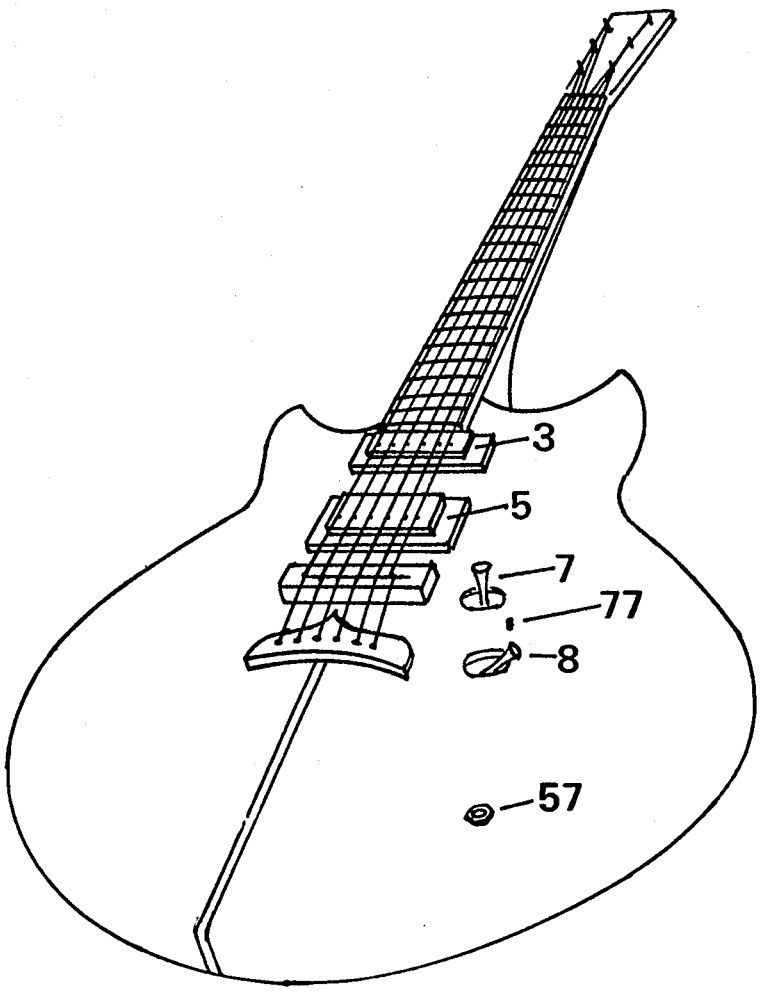
FIG. 1 is a prototype model of a guitar including the joystick controls.

Referring to FIG. 1, an electric guitar can include a finger board pick-up 3 and a bridge pick-up 5. The transducers comprising the pick-ups are well known in the art and require no further description.

In accordance with the invention, one or two joysticks 7 and 8 may be provided. As will be seen, one of the joysticks, 7, provides simultaneous control for pick-up and filter combinations. If volume control and panning are also to be simultaneously provided, a second joystick 8 is needed.

Figure 2:
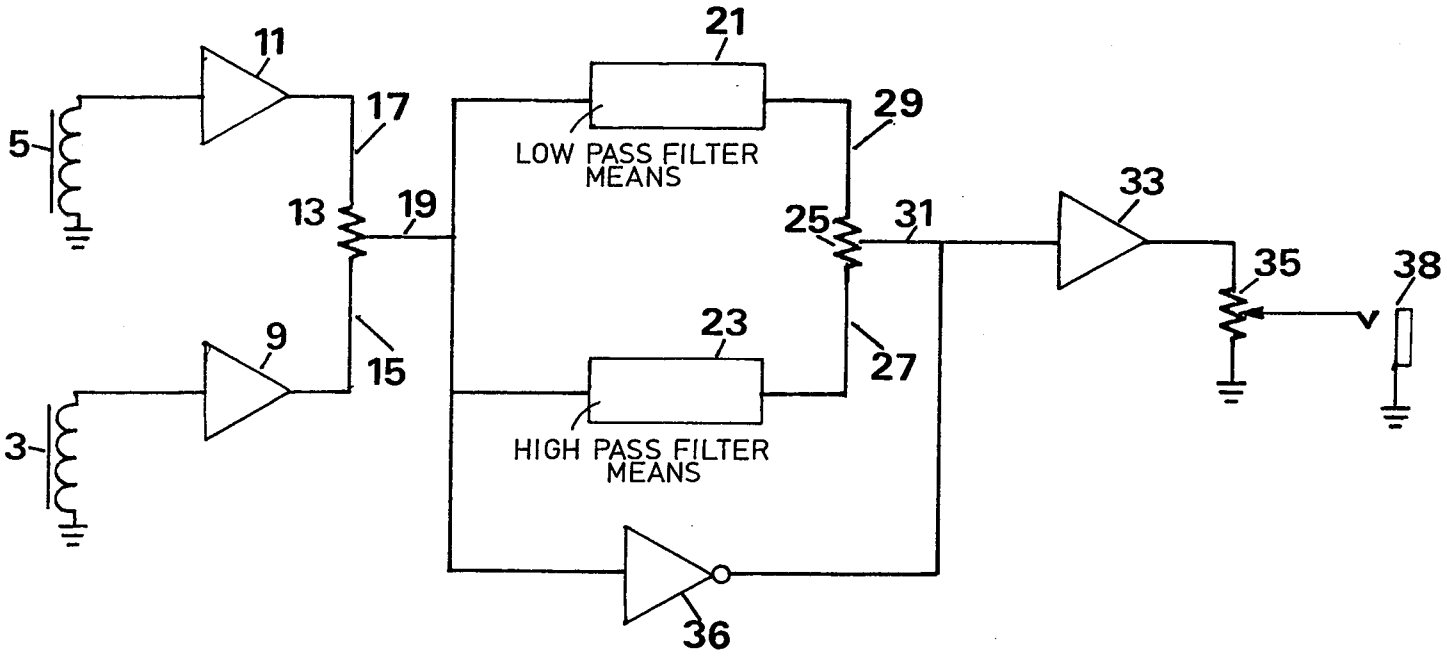
FIG. 2 is a block diagram illustrating simultaneous control of pick-ups and filters.

Referring now to FIG. 2, the outputs of the pick-ups 3 and 5 are fed, respectively, to buffers 9 and 11. A potentiometer 13 has one end 15 connected to the output of the buffer 9 and the other end 17 connected to the output of the buffer 11. Slider arm 19 of the potentiometer 13 is connected to low pass filter means 21 and high pass filter means 23 which are connected in parallel. A second potentiometer 25 has one end 27 connected to the output of the high pass filter means and the other end 29 connected to the output of the low pass filter means 21. Slider arm 31 of potentiometer 25 is connected to output buffer 33, and the output of buffer 33 is connected to a volume control 35.

When the filter means 21 and 23 are inverting filters, then slider arm 19 is also connected to the input of inverter means 36, and the output of the filter selection control, consisting of 21, 23 and 25, is mixed with that of the inverter and then applied to the output buffer circuit 33. The output of the buffer is then applied, as above-described, to the volume control 35 and to an output jack 38.

Figure 3A:
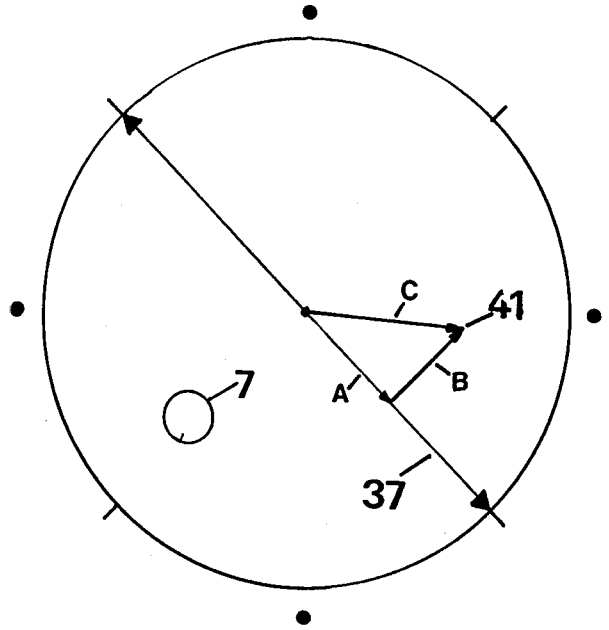
FIGS. 3A and 3B are schematic diagrams illustrating 2-axis joystick action.

As will be explained in association with FIG. 3, the slider arms 31 and 19 of the potentiometers are simultaneously controlled by the joystick means.

Figure 3B:
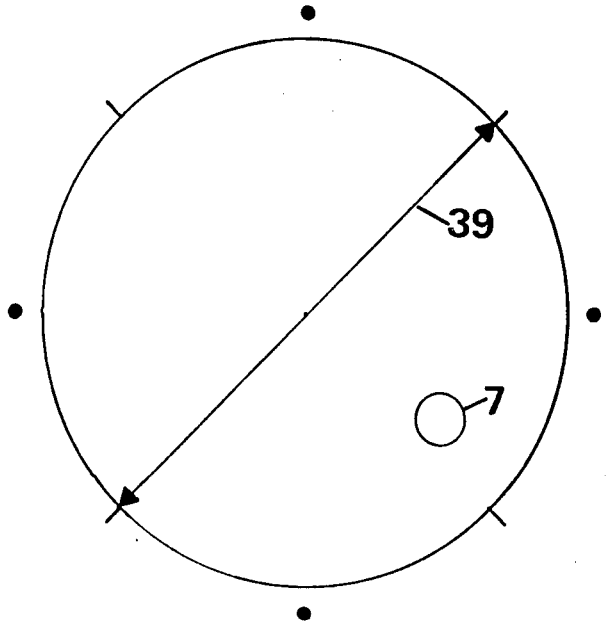

Referring now to FIG. 3, the joystick can be moved along a pick-up selection axis 37 or a filter selection axis 39 which is at right angles to the axis 37. The controls of the joystick assembly are mechanically linked at 90° from each other so that movement of the joystick along one axis will not affect control along the other axis. It can also be moved along other axes which are not in line with the axis 39 or 37 as will be explained below.

When the joystick is moved along the axis 37, it has the effect of moving the slider arm 19 along the potentiometer 15. Specifically, moving the joystick towards the bridge pick-up marking is equivalent to moving the slider arm towards the end 17 of the potentiometer 13.

In a like manner, moving the joystick along the filter selection axis 39 comprises moving the slider arm 31 along the potentiometer 25. Specifically, moving the joystick along the axis 39 in the direction of the treble boost marking is equivalent to moving the slider arm 31 in the direction of the end 29 of the potentiometer 25.

The joystick, as above-mentioned, can also be moved along different axes than the axis 37 or 39. For example, it could be moved along the line C to point 41 shown in FIG. 3A. This is equivalent to moving the joystick along the axis 37 for a distance A and along the axis 39 for a distance B. Thus, the output combination when the joystick is at point 41 includes greater output from the finger board pick-up than from the bridge pick-up and a greater output from the treble boost filter means than from the bass boost filter means. As can be seen, an infinity of combinations can be selected by a movement of a single joystick control.

A similar sort of arrangement can be used for the purpose of providing simultaneous volume control and panning when the output of the instrument is fed to two separated speakers. Such a system is illustrated in FIG. 2 which also illustrates a complete circuit for a working embodiment including both of the joysticks in accordance with the invention.

Figure 4:
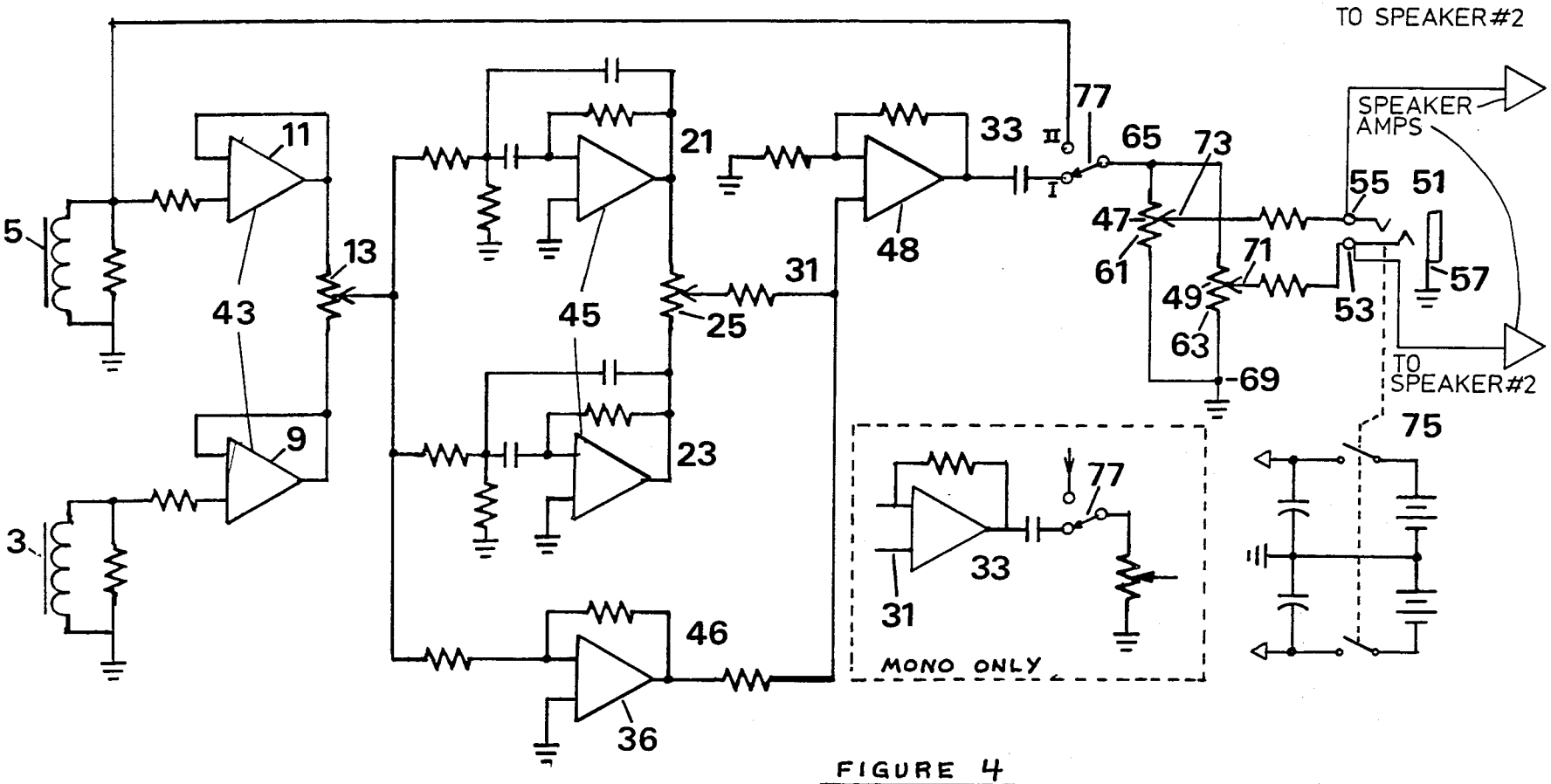
FIG. 4 is a schematic diagram of the electronic circuitry for controlling combination of pick-ups and filters with one joystick and volume and panning with a second joystick.

Turning now to FIG. 4, wherein like numerals indicate like parts to those in FIGS. 1 to 3, the buffer amplifiers 9 and 11 respectively comprise operational amplifiers 43, while the filter means 23 and 25 comprise operational amplifiers 45 with associated resistor capacitor networks as well known in the art. Inverter 36 also comprises an operational amplifier 46.

The circuitry to the right of the abovedescribed circuitry comprises the volume and panning control means. The output of slider arm 31 and inverter 36 is fed to one input of the operational amplifier 48 which comprises the buffer means 33 of FIG. 2. The output of the operational amplifier is fed to volume control potentiometers 47 and 49.

Volume controls 47 and 49 have outputs connected to jack 51 which includes output terminal 53 connected to a first amplifier speaker (not shown) and output terminal 55 connected to a second amplifier speaker (also not shown). The jack 51 also includes a ground connection 57.

The volume controls consist of potentiometers 61 and 63. One of the operational amplifiers 48 is connected to one end 65 of potentiometers 61 and 63 and the other end of potentiometers 61 and 63 are connected at 69 to ground.

Wiper arm 71 of potentiometer 63 is connected to output terminal 53 while wiper arm 73 of potentiometer 61 is connected to output terminal 55. Power supply means 75 provide power for operation as is well known in the art.

From an explanation of FIG. 3, it can be seen how the volume of each speaker can be individually adjusted with both volumes being simultaneously adjustable by movement of a single joystick.

The potentiometers 13 and 25 are, as in FIG. 1, operated by a first joystick, whereas the potentiometers 61 and 63 are operated by a second joystick.

Bypass switch 77 (see also FIG. 1) is provided to bypass the above circuitry in the event of an electronic circuit failure. As can be seen, the bridge pick-ups are passed directly to the output volume controls when switch 77 is moved to position II. If the stereo option is not desired, then the circuitry consisting of the operational amplifier 33 and the potentiometers 61 and 63 would be replaced with the circuitry shown as an inset at the top right hand corner of FIG. 4. This is, of course, identical to the embodiment illustrated in FIG. 2 except that the inset also includes a bypass switch 77. In this embodiment, the volume would be controlled by a potentiometer as well known in the art.

The filter means are preferably band pass filter means with the low pass filter means, or the bass boost means, comprising a low frequency band pass filter means and the high pass filter means, or the treble boost filter means, comprising a high frequency pass band filter means. In a particular embodiment, the low frequency filter is tuned to 115 Hz (center frequency) and has a bandwidth of 60 Hz. The high frequency filter means is tuned at 4000 Hz (center frequency) and has a bandwidth of 2000 Hz.

The arrangement as taught herein can provide a variety of different sounds and volumes including stereo effects, and all of these different sounds can be very easily provided and varied by the operation of one or two joysticks. Thus, the flexibility of electrical string instruments is enhanced with the invention as taught herein.

Although several embodiments have been described, this was for the purpose of illustrating, but not limiting, the invention. Various modifications, which will come readily to the mind of one skilled in the art, are within the scope of the invention as defined in the appended claims.

I claim:

1. An electrical stringed and fretted musical instrument;

comprising:

a first pick-up means and a second pick-up means;

a first potentiometer having a first end, a second end and a slider arm disposed between said first and second ends;

said first pick-up means being connected to said first end of the first potentiometer and said second pick-up means being connected to said second end of the first potentiometer;

a high pass filter means having an input terminal and an output terminal;

a low pass filter means having an input terminal and an output terminal;

said slider arm of the first potentiometer being connected in parallel to both said low pass filter means input terminal and high pass filter means input terminal;

a second potentiometer having a first end, a second end, and a slider arm disposed between said first and second ends;

the output terminal of said high pass filter means being connected to said first end of said second potentiometer;

the output terminal of said low pass filter means being connected to the second end of said second potentiometer;

output means;

the slider arm of said second potentiometer being connected to said output means;

wherein, said first and second potentiometers are controlled by a 2-axis joystick means whereby to simultaneously combine the outputs of said first pick-up means, said second pick-up means, said high pass filter means and said low pass filter means at said output means.

2. An instrument as defined in claim 1 wherein, when said joystick is moved along one axis thereof, the proportion of the output of one of said pick-up means will increase at said output means whereas the proportion of the output of the other one of said pick-up means will decrease;

and wherein when the joystick is moved along the other axis thereof, the proportion of the output of one of said filter means will increase at said output means whereas the proportion of the output of the other one of said filter means will decrease; and when said joystick is moved along an axis between said one and other axes, the proportion of outout of said first pick-up means, said second pick-up means, said high pass filter means and said low pass filter means will be simultaneously varied at said output means.

3. An instrument as defined in claim 2 wherein said output means comprises a volume control comprising a variable resistor connected to a speaker amplifier.

4. An instrument as defined in claim 3 wherein said low pass filter means comprises a band pass filter having a center frequency of 115 Hz and a bandwidth of 60 Hz; and wherein said high pass filter means comprises a band pass filter having a center frequency of 4000 Hz and a bandwidth of 2000 Hz.

5. An instrument as defined in claim 1 wherein said output means comprises a first speaker amplifier and a second speaker amplifier;

and further comprising means for simultaneously controlling the volume on both said speakers and the panning of both said speakers;

wherein said third and fourth potentiometers are controlled by a second 2-axis joystick means whereby to simultaneously control the volume on both said speaker amplifiers and the panning of said speaker amplifiers.

6. An instrument as defined in claim 4 wherein said means for simultaneously controlling comprises a third potentiometer and a fourth potentiometer, each of said third and fourth potentiometers having a first end and a second end and slider arms;

a buffer means;

the first end of both said third and fourth potentiometers being connected together, said slider arm of said second potentiometer being connected to said connected together first ends of said third and fourth potentiometers through said buffer means;

the second end of said third and fourth potentiometers being connected together and to ground;

the slider arm of said third potentiometer being connected to a first one of said speaker amplifiers; and the slider arm of said fourth potentiometer being connected to the other one of said speaker amplifiers.

7. An instrument as defined in claim 6 wherein said slider arm of said second potentiometer is connected to the first ends of said third and fourth potentiometers through a buffer amplifier.

8. An instrument as defined in claim 7 wherein said low pass filter means comprises a band pass filter having a center frequency of 115 Hz and a bandwidth of 60 Hz; and wherein said high pass filter means comprises a band pass filter having a center frequency of 4000 Hz and a bandwidth of 2000 Hz.

* * * * *